US008344960B2

(12) United States Patent
Chou

(10) Patent No.: US 8,344,960 B2
(45) Date of Patent: Jan. 1, 2013

(54) COMPACT ANTENNA

(75) Inventor: Chen-Yu Chou, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 328 days.

(21) Appl. No.: 12/905,088

(22) Filed: Oct. 15, 2010

(65) Prior Publication Data

US 2012/0001819 A1 Jan. 5, 2012

(30) Foreign Application Priority Data

Jul. 2, 2010 (TW) ..... 99121821 A

(51) Int. Cl.
*H01Q 9/16* (2006.01)

(52) U.S. Cl. ..... 343/792; 343/793

(58) Field of Classification Search ..... 343/792, 343/793, 790, 791, 829, 799
See application file for complete search history.

(56) References Cited

U.S. PATENT DOCUMENTS

| | | | | |
|---|---|---|---|---|
| 4,730,195 | A * | 3/1988 | Phillips et al. | 343/792 |
| 5,440,317 | A * | 8/1995 | Jalloul et al. | 343/791 |
| 2004/0066350 | A1* | 4/2004 | Ming | 343/792 |
| 2006/0109190 | A1* | 5/2006 | Chen et al. | 343/792 |

* cited by examiner

*Primary Examiner* — Hoanganh Le
(74) *Attorney, Agent, or Firm* — Winston Hsu; Scott Margo

(57) ABSTRACT

A compact antenna for transmitting or receiving a radio frequency signal includes a metal wire extending from a first location to a second location, an insulation layer extending from the first location to a third location, for covering a portion of the metal wire from the first location to the third location, a metal weave extending from the first location to a fourth location, for covering a portion of the insulation layer from the first location to the fourth location, and a grounding metal tube extending from a fifth location to the third location, for covering a portion of the metal weave from the fifth location to the fourth location, and covering a portion of the insulation layer from the fourth location to the third location.

9 Claims, 9 Drawing Sheets

| Frequency (GHz) | 2.4 | 2.41 | 2.42 | 2.43 | 2.44 | 2.45 | 2.46 | 2.47 | 2.48 | 2.49 | 2.5 |
|---|---|---|---|---|---|---|---|---|---|---|---|
| Efficiency(%) | 68.6997 | 72.5993 | 75.5998 | 79.1704 | 81.4944 | 81.2415 | 82.0569 | 81.0837 | 77.4395 | 78.5638 | 76.0358 |
| Gain(dBi) | 2.70228 | 2.90043 | 3.04867 | 3.23709 | 3.36453 | 3.37489 | 3.50585 | 3.37693 | 3.26861 | 3.28051 | 3.0823 |
| Average gain(dB) | -1.6305 | -1.3907 | -1.2148 | -1.0144 | -0.8887 | -0.9022 | -0.8588 | -0.9107 | -1.1104 | -1.0478 | -1.7898 |

FIG. 3

COMPACT ANTENNA

BACKGROUND OF THE INVENTION

1. Field of the Invention

The present invention relates to a compact antenna, and more particularly, to a compact antenna with a compact size, excellent radiating efficiency and pattern, and capable of meeting requirements of wireless communication.

2. Description of the Prior Art

An antenna is utilized for transmitting or receiving radio waves, so as to transfer or exchange radio signals. An electronic product with wireless communication functions, such as a laptop, smart phone, etc., generally utilizes a built-in antenna to access wireless network. Therefore, in order to let a user to access wireless communication network more conveniently, a bandwidth of an ideal antenna should be extended as broadly as possible within a tolerable range, while a size thereof should be minimized as much as possible, such that the antenna can be integrated into a portable wireless communication device.

SUMMARY OF THE INVENTION

It is therefore an objective of the present invention to provide a compact antenna.

The present invention discloses a compact antenna for transmitting or receiving a radio frequency signal. The compact antenna includes a metal wire, extending from a first location to a second location, an insulation layer, extending from the first location to a third location, for covering a portion of the metal wire from the first location to the third location, a length from the first location to the third location less than a length from the first location to the second location, a metal weave, extending from the first location to a fourth location, for covering a portion of the insulation layer from the first location to the fourth location, a length from the first location to the fourth location less than a length from the first location to the third location; and a grounding metal tube, extending from a fifth location to the third location, for covering a portion of the metal weave from the fifth location to the fourth location, and covering a portion of the insulation layer from the fourth location to the third location, the fifth location between the first location and the fourth location.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3 is a statistic table of antenna efficiencies, gains and average gains of the compact antenna shown in FIG. 1A at different frequencies.

DETAILED DESCRIPTION

Figure 1A:
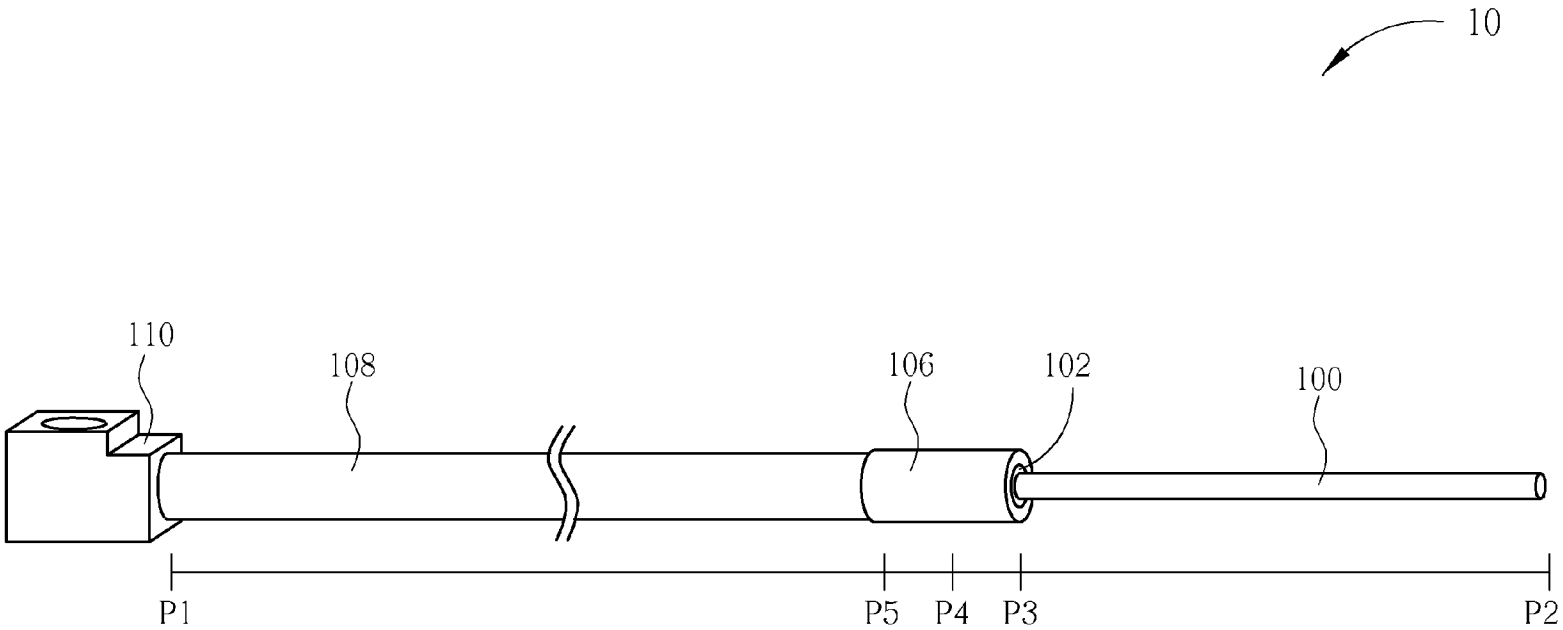
FIG. 1A is a schematic diagram of an appearance of a compact antenna according to an embodiment of the present invention.
Figure 1B:
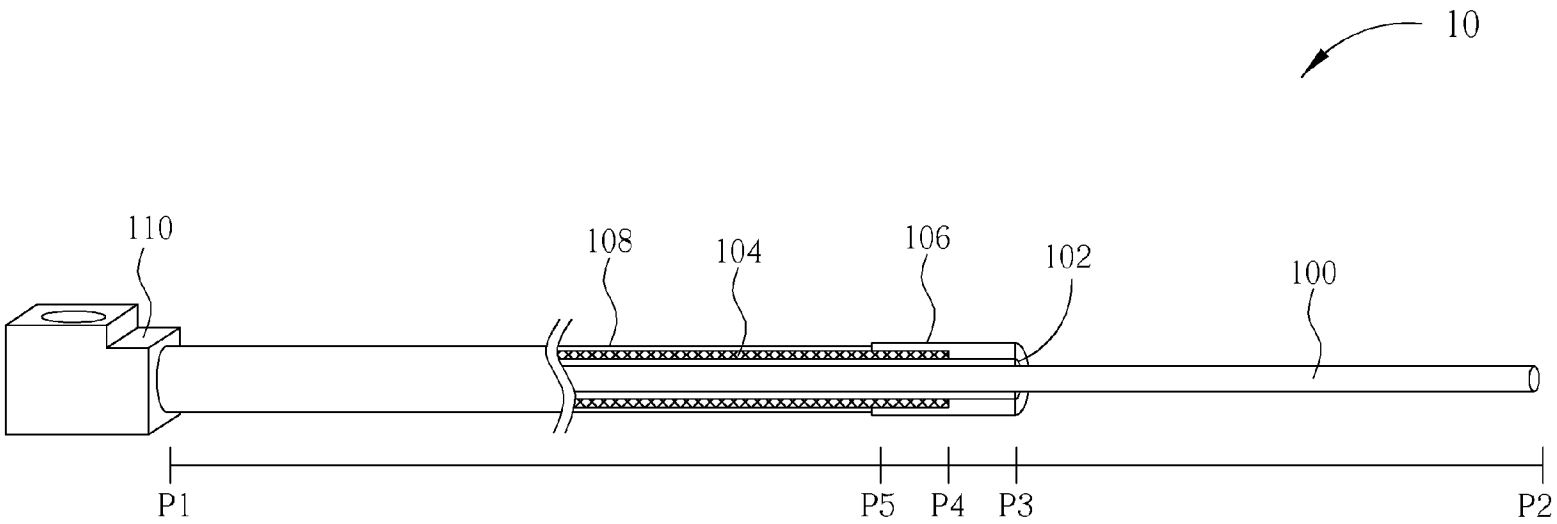
FIG. 1B is a schematic diagram of a cross-section of the compact antenna.

Please refer to FIG. 1A and FIG. 1B. FIG. 1A is a schematic diagram of an appearance of a compact antenna 10 according to an embodiment of the present invention, while FIG. 1B is a schematic diagram of a cross-section of the compact antenna 10. The compact antenna 10 can be applied in a wireless communication device, for transmitting or receiving radio frequency (RF) signals with a wavelength λ. The compact antenna 10 mainly includes a metal wire 100, an insulation layer 102, a metal weave 104, a grounding metal tube 106, a protection layer 108 and a signal terminal 110. For clearly illustrating a structure of the compact antenna 10, FIG. 1A and FIG. 1B denote five locations P1, P2, P3, P4, P5. In detail, the metal wire 100 extends from the location P1 to the location P2; a portion of the metal wire 100 from the location P1 to the location P3 can be taken as a signal wire, and a portion from the location P3 to the location P2 is a radiator. The insulation layer 102 extends from the location P1 to the location P3, for covering the portion of the metal wire 100 from the location P1 to the location P3. The insulation layer 102 is formed by insulation material such as teflon, but is not limited to this. The metal weave 104 extends from the location P1 to the location P4, for covering a portion of the insulation layer 102 from the location P1 to the location P4, to provide metal shielding effect. The grounding metal tube 106 extends from the location P5 to the location P3, and is formed by metal material such as copper, for providing grounding. A portion of the grounding metal tube 106 from the location P5 to the location P4 covers the metal weave 104 and is electrically connected to the metal weave 104. A portion of the grounding metal tube 106 from the location P4 to the location P3 covers the insulation layer 102. The protection layer 108 extends from the location P1 to the location P5, for covering a portion of the metal weave 104 from the location P1 to the location P5. Finally, the signal terminal 110 is formed at the location P1, for transmitting or receiving the RF signals.

Figure 2:
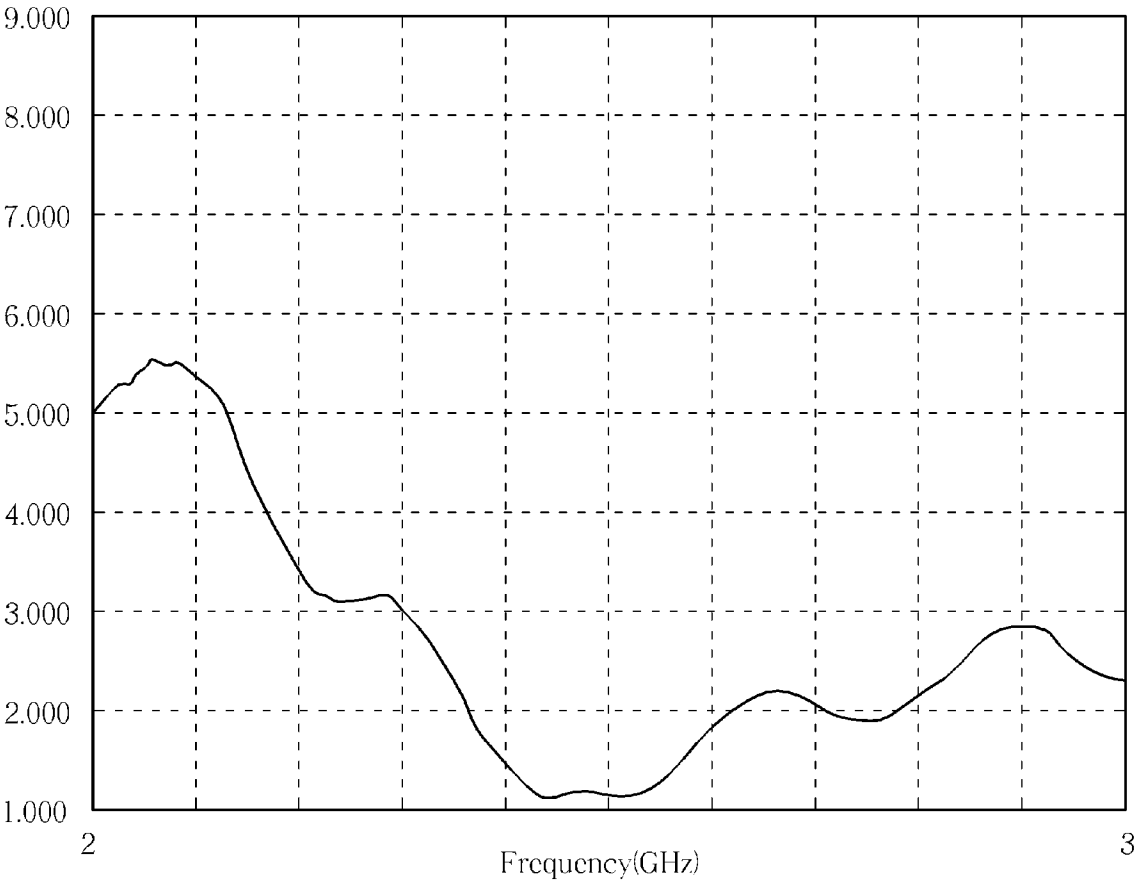
FIG. 2 is a schematic diagram of voltage standing wave ratio (VSWR) of the compact antenna shown in FIG. 1A.
Figure 4:
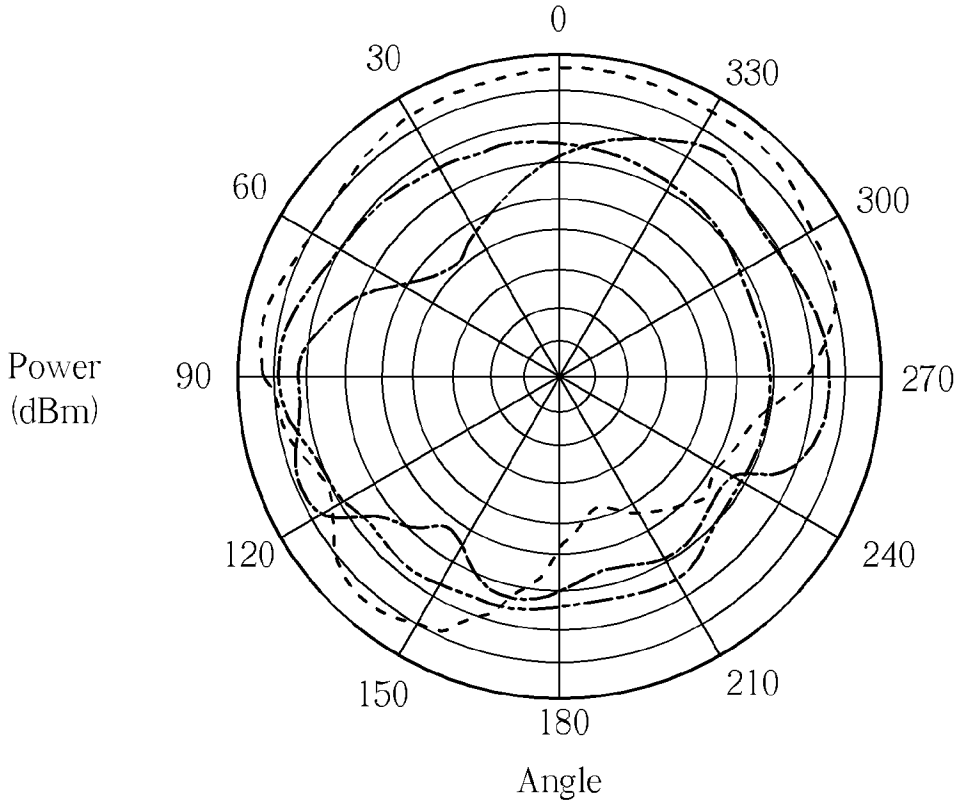
FIG. 4 to FIG. 6 are schematic diagrams of radiating patterns of the compact antenna shown in FIG. 1A at 2.5 GHz, 2.45 GHz and 2.4 GHz, respectively.
Figure 5:
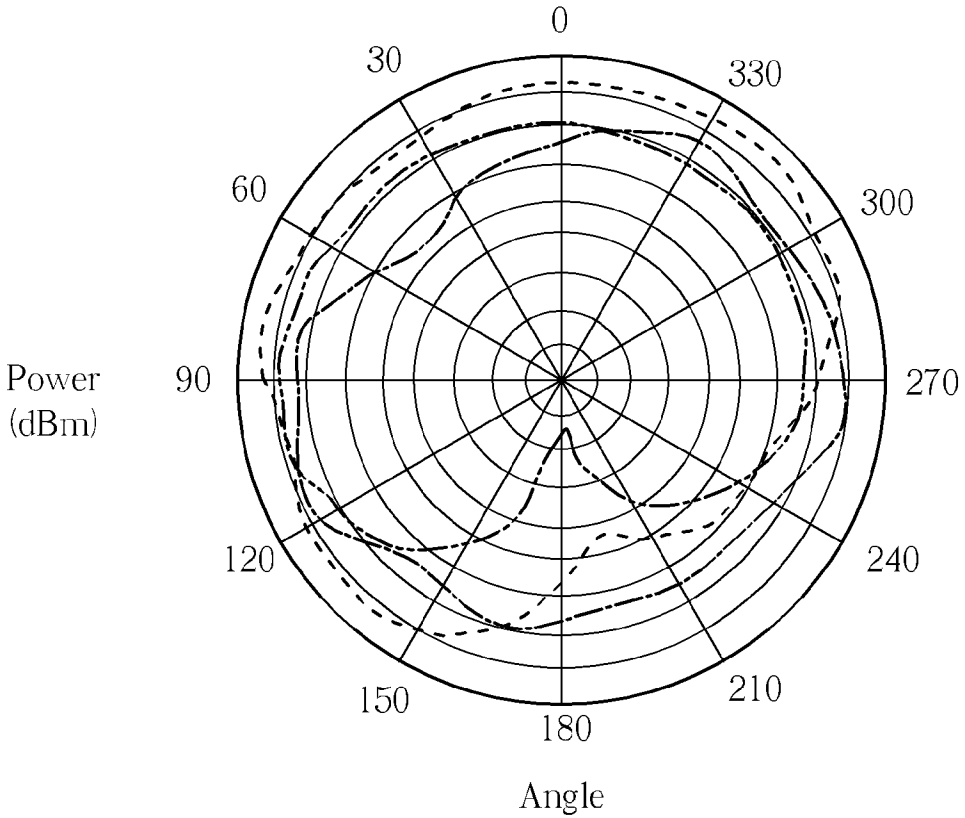
Figure 6:
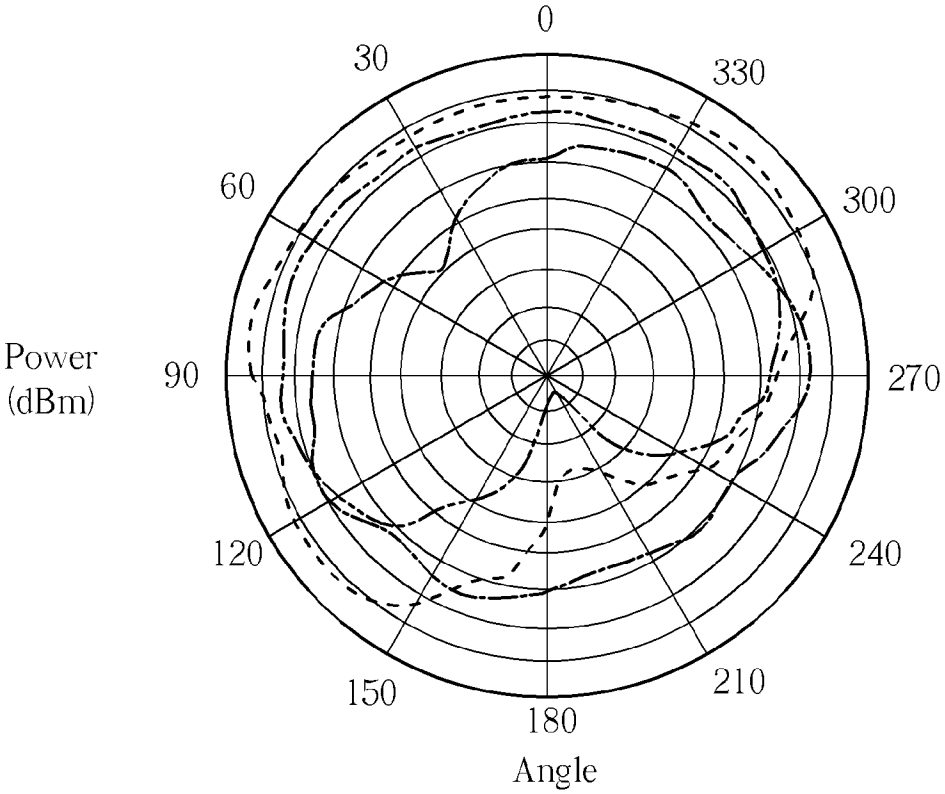

In the compact antenna 10, a length from the location P2 to the location P3 is substantially three quarters of the wavelength λ, a length from the location P3 to the location P5 is substantially a quarter of the wavelength λ, and a length from the location P3 to the location P4 and a length from the location P4 to the location P5 are both substantially one eighth of the wavelength λ. Besides, in realization of the compact antenna 10, designers should properly adjust the lengths of line sections from the location P2 to the location P3, from the location P3 to the location P5, from the location P3 to the location P4 and from the location P4 to the location P5 according to system requirements and experimental or simulation results. For example, when the compact antenna 10 is applied in a Bluetooth or WLAN system, a central frequency is around 2.4 GHz, and thus experimental results can be derived as in FIG. 2 to FIG. 6 by adjusting the lengths of the line sections. FIG. 2 is a schematic diagram of voltage standing wave ratio (VSWR) of the compact antenna 10, FIG. 3 is a statistic table of antenna efficiencies, gains and average gains of the compact antenna 10 at different frequencies, and FIG. 4 to FIG. 6 are schematic diagrams of radiating patterns of the compact antenna 10 at 2.5 GHz, 2.45 GHz and 2.4 GHz, respectively. Therefore, as can be seen from FIG. 2 to FIG. 6, the compact antenna 10 is a dipole antenna, and operating frequency band thereof (taking VSWR less than 2 as an example) conforms to requirements of a Bluetooth or WLAN system.

On the other hand, as can be seen from FIG. 1A and FIG. 1B, the compact antenna 10 is modified from a cable wire, and can be manufactured by various methods. Two methods are as follows.

Figures 7A, 7B, 7C, 7D, 7E:
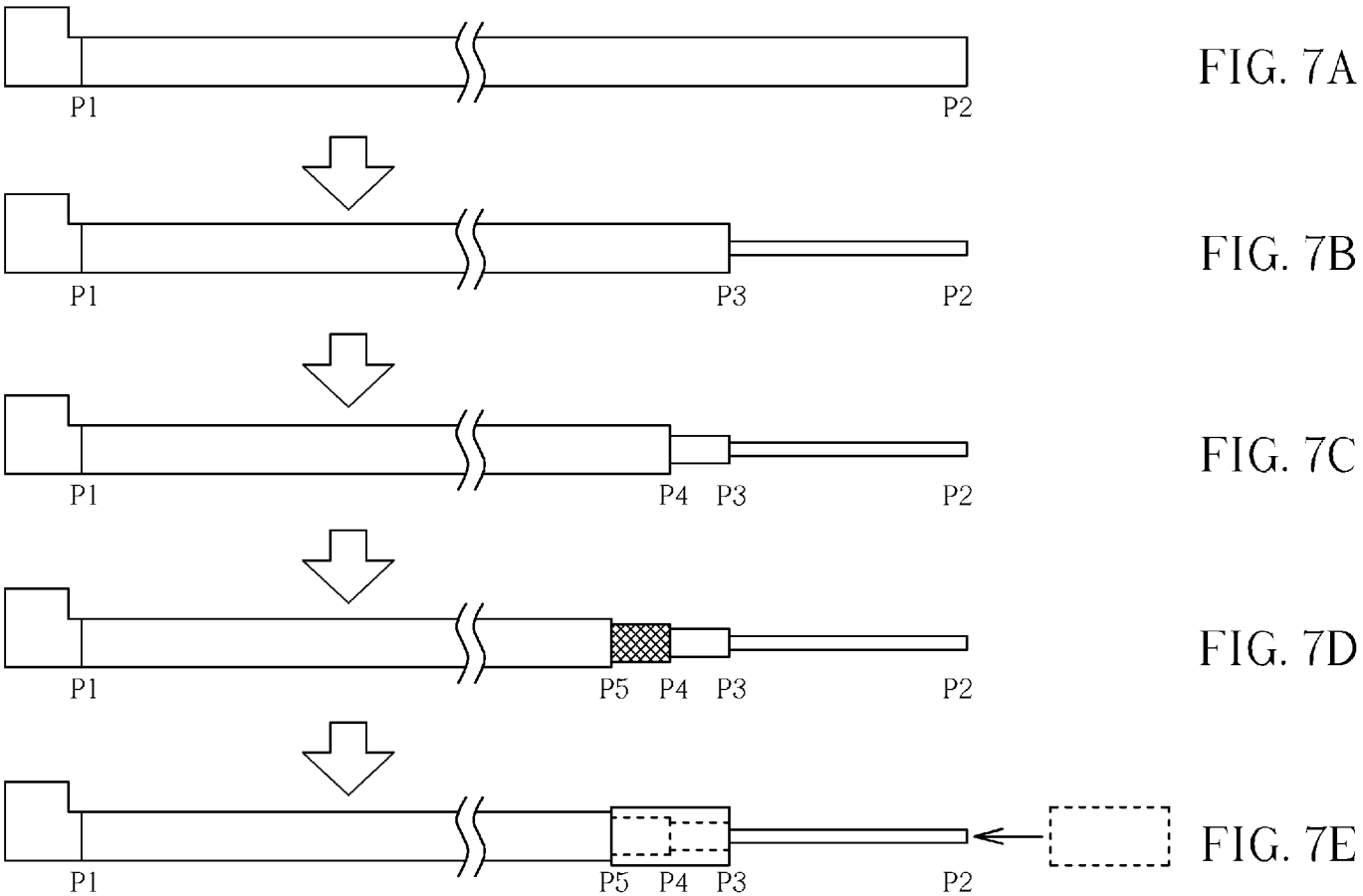
FIG. 7A to FIG. 7E are schematic diagrams of a manufacturing process of the compact antenna shown in FIG. 1A according to an embodiment of the present invention.

Please refer to FIG. 7A to FIG. 7E, which are schematic diagrams of a manufacturing process of the compact antenna 10 according to an embodiment of the present invention. As shown in FIG. 7A, a cable wire with a proper length is acquired first, and the cable wire is formed by a metal wire, an insulation layer, a metal weave and a protection layer from inside to outside, respectively. Then, as shown in FIG. 7B, the protection layer, the metal weave and the insulation layer of the cable wire from the location P3 to the location P2 are removed, and only the metal wire portion is left, i.e. a radiator portion. As shown in FIG. 7C, the protection layer and the metal weave of the cable wire from the location P4 to the location P3 are removed, and only the insulation layer and the covered metal wire thereof are left. As shown in FIG. 7D, the protection layer of the cable wire from the location P5 to the location P4 are removed, and the metal weave, the insulation layer and the covered metal wire thereof are left. Finally, as shown in FIG. 7E, a grounding metal tube is cased on the portion of the cable wire from the location P5 to the location P3 and is connected to the metal weave, while a grounding terminal is set in, such that the compact antenna 10 is completed.

Figures 8A, 8B, 8C, 8D, 8E:
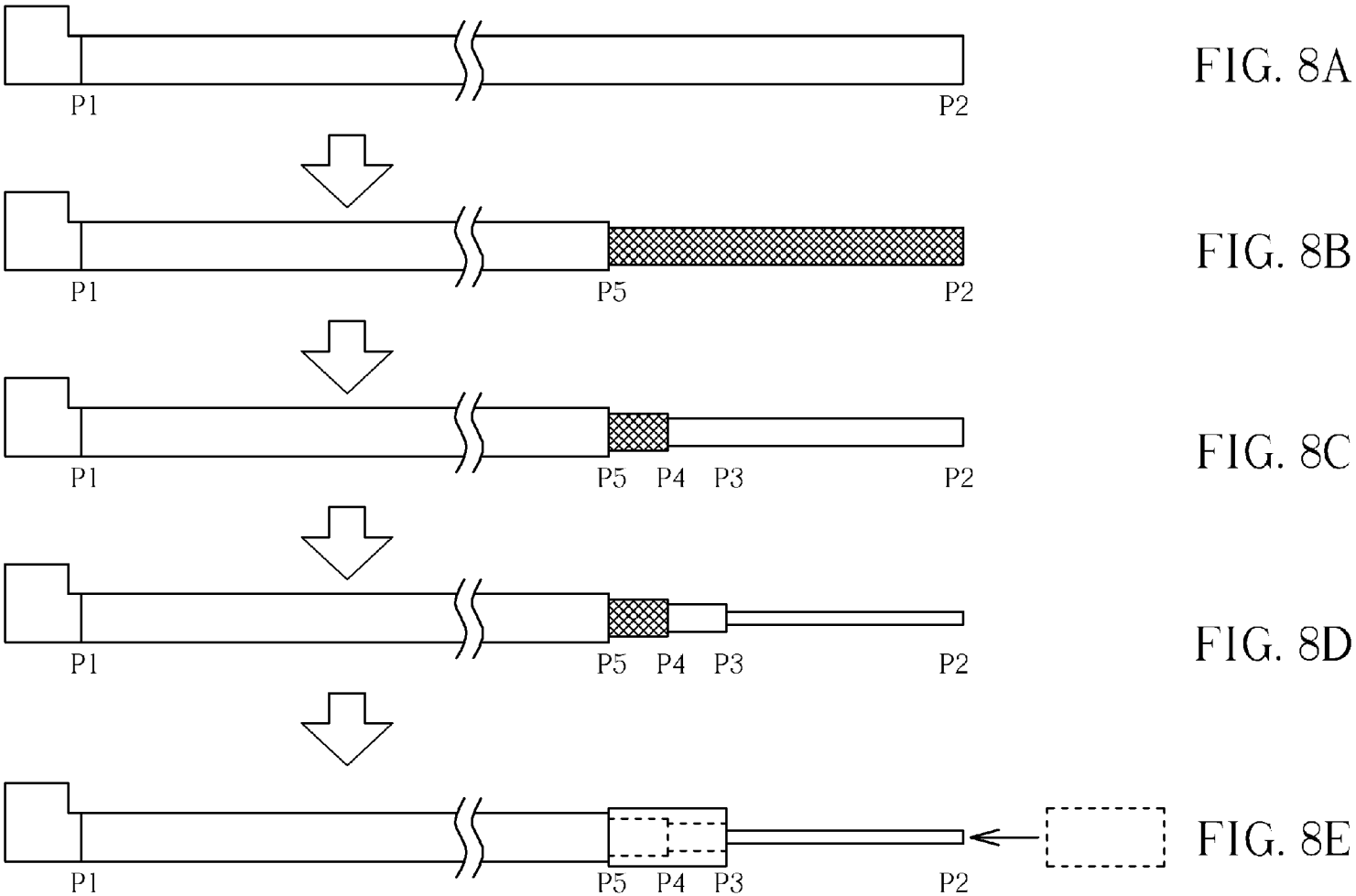
FIG. 8A to FIG. 8E are schematic diagrams of another manufacturing process of the compact antenna shown in FIG. 1A according to an embodiment of the present invention.

The manufacturing process from FIG. 7A to FIG. 7E is sequentially processed by line sections, and another method of manufacturing the compact antenna 10 is by layers. Please refer to FIG. 8A to FIG. 8E, which are schematic diagrams of another manufacturing process of the compact antenna 10 according to an embodiment of the present invention. As shown in FIG. 8A, a cable wire with a proper length is acquired first, and the cable wire is formed by a metal wire, an insulation layer, a metal weave and a protection layer from inside to outside, respectively. Then, as shown in FIG. 8B, the protection layer of the cable wire from the location P5 to the location P2 are removed, such that the metal weave is exposed. As shown in FIG. 8C, the metal weave from the location P4 to the location P2 are removed, such that the insulation layer is exposed. As shown in FIG. 8D, the insulation layer from the location P3 to the location P2 are removed, such that the metal wire is exposed. Finally, as shown in FIG. 8E, a grounding metal tube is cased on the cable wire from the location P5 to the location P3 and is connected to the metal weave, while a grounding terminal is set in, such that the compact antenna 10 is completed.

Noticeably, FIG. 7A to FIG. 7E or FIG. 8A to FIG. 8E are only utilized for illustrating feasible manufacturing processes of the compact antenna 10, and such manufacturing processes should be easily completed by those skilled in the art by referring the structure of the compact antenna 10. However, other manufacturing methods, such as forming the compact antenna 10 from inside to outside, are also feasible and not limited to these.

An objective of the present invention is to utilize a conventional cable wire to manufacture the compact antenna 10 of dipole, and thus the main radiator is a metal wire with a diameter of around 2.5 mm, which conforms to requirements of a compact size. More importantly, as can be proved by experimental results shown in FIG. 2 to FIG. 6, the compact antenna 10 of the present invention has excellent radiating efficiency and patterns in the operating frequency band, and thus can effectively receive or transmit the RF signals. In addition, since resistance of a cable wire is generally designed at 50 ohm, such that the compact antenna 10 has excellent matching results, which facilitates system integration. Moreover, the compact antenna 10 does not need an adapter block, which reduces power loss due to an adapter block, and thus further enhances efficiency.

To sum up, the compact antenna of the present invention is manufactured from a conventional cable wire, and conforms to requirements of a compact size, while has excellent radiating efficiency and pattern, so as to meet requirements of a wireless communication system.

Those skilled in the art will readily observe that numerous modifications and alterations of the device and method may be made while retaining the teachings of the invention.

What is claimed is:

1. A compact antenna for transmitting or receiving a radio frequency (RF) signal, comprising:

a metal wire, extending from a first location to a second location;

an insulation layer, extending from the first location to a third location, for covering a portion of the metal wire from the first location to the third location, a length from the first location to the third location less than a length from the first location to the second location;

a metal weave, extending from the first location to a fourth location, for covering a portion of the insulation layer from the first location to the fourth location, a length from the first location to the fourth location less than a length from the first location to the third location; and a grounding metal tube, extending from a fifth location to the third location, for covering a portion of the metal weave from the fifth location to the fourth location, and covering a portion of the insulation layer from the fourth location to the third location, the fifth location between the first location and the fourth location.

2. The compact antenna of claim 1, wherein a length from the third location to the second location is substantially equal to three quarters of a wavelength of the RF signal.

3. The compact antenna of claim 1, wherein a length from the fifth location to the third location is substantially equal to a quarter of a wavelength of the RF signal.

4. The compact antenna of claim 1, wherein a length from the fifth location to the fourth location is substantially equal to one eighth of a wavelength of the RF signal.

5. The compact antenna of claim 1, wherein a length from the fourth location to the third location is substantially equal to one eighth of a wavelength of the RF signal.

6. The compact antenna of claim 1, wherein the grounding metal tube is electrically connected to the portion of the metal weave from the fifth location to the fourth location.

7. The compact antenna of claim 1, wherein resistance of the metal wire is 50 ohm.

8. The compact antenna of claim 1 further comprising a signal terminal, formed at the first location.

9. The compact antenna of claim 1 further comprising a protection layer, extending from the first location to the fifth location, for covering a portion of the metal weave from the first location to the fifth location.

* * * * *